United States Patent [19]

Damsky

[11] 4,105,884

[45] Aug. 8, 1978

[54] ELECTRICAL TOGGLE SWITCH LEVER EXTENDER

[76] Inventor: Arnold M. Damsky, 821 83rd St., Miami Beach, Fla. 33141

[21] Appl. No.: 784,042

[22] Filed: Apr. 4, 1977

[51] Int. Cl.[2] ..... H01H 3/20

[52] U.S. Cl. ..... 200/331; 74/503; 74/544; 200/338

[58] Field of Search ..... 74/503, 544; 200/153 G, 200/330, 331, 333, 338; 220/3.7

[56] References Cited

U.S. PATENT DOCUMENTS

| | | | |
|---|---|---|---|
| 1,961,728 | 6/1934 | Arnest et al. | 220/3.7 |
| 2,571,837 | 10/1951 | Coles | 200/330 |
| 2,794,891 | 6/1957 | Appleton | 200/330 |
| 2,813,938 | 11/1957 | Speizman | 200/333 |
| 3,169,410 | 2/1965 | Armandroff | 200/330 |
| 3,188,438 | 6/1965 | Lovasco | 200/333 |
| 3,242,297 | 3/1966 | Piber | 200/338 |
| 3,356,819 | 12/1967 | Zavertink et al. | 200/330 |
| 3,816,686 | 6/1974 | Budd et al. | 200/330 |
| 3,946,186 | 3/1976 | Howie, Jr. | 200/330 |

*Primary Examiner*—William Price
*Assistant Examiner*—Bruce H. Bernstein
*Attorney, Agent, or Firm*—Ernest H. Schmidt

[57] ABSTRACT

A substitute toggle switch cover plate has an elongated opening within which is reciprocatively captured an actuating member having a recessed carrier portion at the inside adapted to loosely enclose the control lever of an electrical toggle switch, and a slide knob at the outside for moving the carrier member together with the toggle switch lever between "on" and "off" positions.

5 Claims, 7 Drawing Figures

ELECTRICAL TOGGLE SWITCH LEVER EXTENDER

In the remodeling of rooms by the installation of paneling, for example, or other materials of substantial thickness, particularly when furring strips are used between the wall surface and the paneling or other sheet material used for remodeling, difficulties are often encountered in relocating electrical lighting toggle switches in the paneling. Heretofore, it has been common practice to remove the switch from its electrical connector box and attach it, by means of wood screws or the like, against marginal portions of an opening cut in a panel for this purpose, to be covered thereafter by a cover plate in the usual manner. If the original wiring in the connector box happened to be too short to permit the required extension of the switch, splicing became necessary, making the relocation even more difficult. More often than not such relocation of switches was done by the carpenter installing the paneling instead by a licensed electrician, resulting, not infrequently, in a faulty or hazardous electrical wiring condition.

It is, accordingly, the principal object of this invention to provide a novel and improved electrical toggle switch lever extender for use in renovating with wall paneling and the like, that obviates the above-described difficulties and hazards in the relocation of properly installed existing light switches.

A more particular object of the invention is to provide a toggle switch lever extender of the character described which will permit simple mechanical interconnection with the toggle switch actuating lever without the necessity of removing the switch from its switch box and without even requiring the removal of the original switch plate.

Another object of the invention is to provide a household toggle switch extender of the above nature including a cover plate having an elongated opening within which is reciprocatively captured a mechanical actuating member having at the inside a recess adapted to be positioned in enclosing relation over an outer end portion of the switch lever of the toggle switch to be extended, and, at the outside, a slide knob for moving the carrier member back and forth for remotely actuating the switch toggle lever back and forth between "on" and "off" positions.

Another object of the invention is to provide an electrical toggle switch extender of the above nature including means for readily shortening the length of the carrier member to accommodate to the particular distance between the covered wall in which the switch is located and the outer paneling.

Yet another object of the invention is to provide an electrical toggle switch extender of the character described which will be simple in construction, economical to manufacture, simple to install and safe and dependable in operation.

Other objects, features and advantages of the invention will be apparent from the following description when read with reference to the accompanying drawings. In the drawings, wherein like reference numerals denote corresponding parts throughout the several views.

Figure 1:
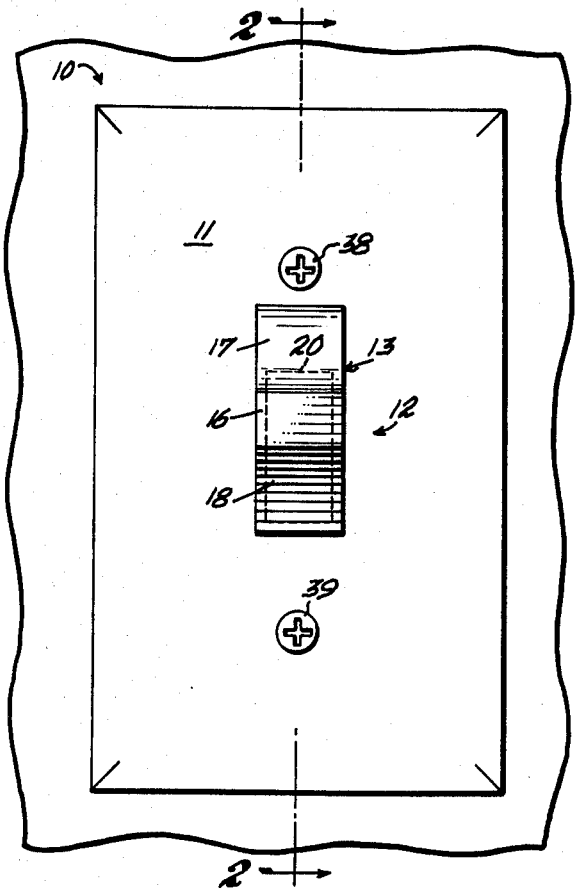
FIG. 1 is a partial front elevational view showing an electrical toggle switch lever extender embodying the invention installed in wall renovating paneling.
Figure 2:
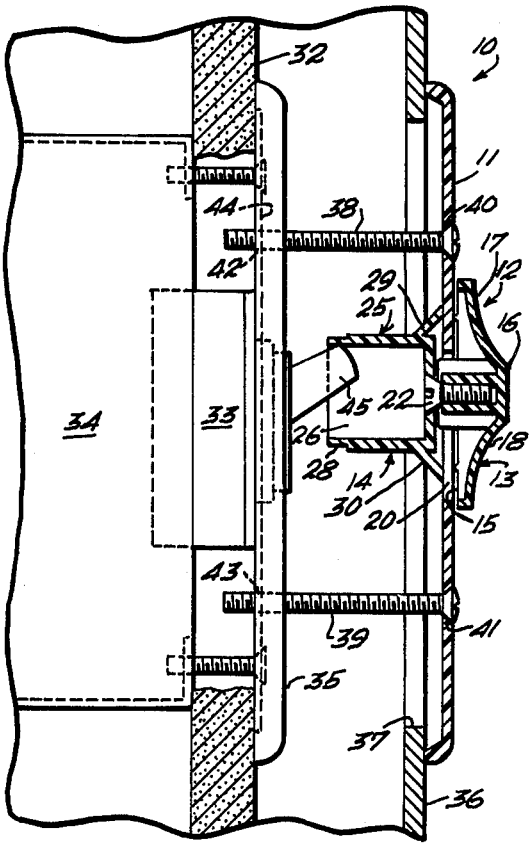
FIG. 2 is a longitudinal cross-sectional view taken through the panelled wall section line 2—2 of FIG. 1 in the direction of the arrows and illustrating constructional and operational details of the toggle switch lever extender.
Figure 3:
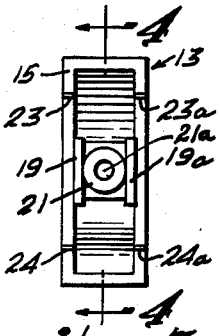
FIG. 3 is a bottom view of the slide knob, shown separately.
Figure 4:
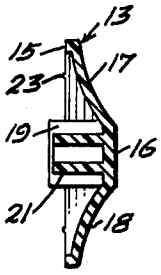
FIG. 4 is a longitudinal cross-sectional view of the slide knob, taken along the line 4—4 of FIG. 3 in the direction of the arrows.
Figure 5:
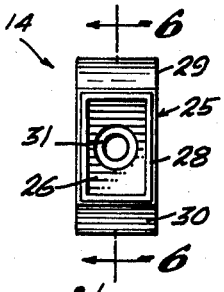
FIG. 5 is an inner end view of the carrier member, shown separately.
Figure 6:
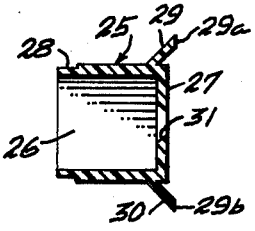
FIG. 6 is a longitudinal cross-sectional view of the carrier member, taken along the line 6—6 thereof in the direction of the arrows.
Figure 7:
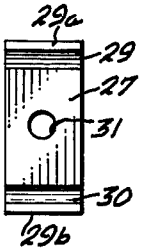
FIG. 7 is an outer view thereof.

Referring now in detail to the drawings, reference numeral 10 in FIGS. 1 and 2 designates, generally, an electrical toggle switch lever extender embodying the invention. As best illustrated in FIG. 2, the switch lever extender 10 comprises a cover plate 11 carrying an actuating slide member 12 comprising a slide knob 13 at the outside of said cover member and a carrier member 14 at the inside of said cover member. The slide knob 13, illustrated separately in FIGS. 3 and 4, is preferably integrally formed of a tough synthetic plastic material, such as by injection molding, and comprises a rectangular base 15 having a marginal flat surface portion, and an outwardly projecting, symmetrical knob portion 16 which tapers inwardly to each end of the slide knob along opposed arcuate surface portions 17 and 18. The underside of the slide knob 13 has integrally formed therein and projecting centrally outwardly thereof a pair of opposed, laterally-spaced, slide abutment members 19 and **19*a* which extend beyond the marginal flat surface portion 15, and which define, at the outsides thereof, laterally-spaced, parallel surface portions slidingly receivable for receprocative movement within the usual switch lever slot 20 in the cover plate 11, (see FIGS. 1 and 2) The slide knob 13 is also integrally formed with a circular central post 21 between the slide abutment members 19 and 19*a* for interthreading reception of an assembly screw 22, (see FIG. 2), as is hereinafter more particularly described. As further illustrated in FIGS. 2, 3 and 4, the slide knob 13 has integrally formed therewith, in the marginal flat base portion 15, a pair of laterally-opposed projections 23, 23*a* and 24, 24*a***, near each end, respectively.

The carrier member 14, which will also preferably be integrally molded, such as by injection molding, of a tough synthetic plastic material, comprises a rectangular body member 25 defining a rectangular recess 26 and formed at one end with a closure wall 27. An outer peripheral marginal portion of the open or recessed end of the body member 25 is inwardly offset to provide a marginal end portion 28 of decreased thickness, for the purpose hereinafter appearing. The body member 25 of the carrier member 14 is also integrally formed, near the closed end thereof, with a pair of opposed, angularly-outwardly-extending, flexible wing portions 29, 30 which project somewhat beyond the outer surface of the end closure wall 27 and which terminate in end surface portions **29*a*, 29*b*, respectively, lying in plane parallel with the plane of said outer surface. The shallow projections 23, 23*a* and 24, 24*a* on the undersurface of the slide knob 13, and the reduced sliding surface area provided by the end surface portions 29*a*, 29*b* of the wing portions 29, 30 of the carrier member 14 reduce the sliding friction of the assemblage with respect to the cover plate 11 to a minimum. An internally chamfered central opening 31 in the end wall 27 of the hollow body member 25 is adapted to receive the assembly screw 22 for assembling the slide knob 13 and the carrier member 14 to the cover plate 11, as is best illustrated in FIG. 2, said screw being self-tapping in its reception within the cylindrical opening 21***a* of the tubular post 21. With reference to FIG. 2, it will be noted that the slide abutment members 19 and 19*a* of the slide knob 13 are of such length that they pass fully through the switch lever slot 20 of the associated cover plate 11, and are so spaced as to be slidingly received between the side walls of said cover plate slot.

Referring now to FIGS. 1 and 2 and considering a typical installation of an electrical toggle switch lever extender embodying the invention, reference numeral 32 designates the outer surface of a wall to be renovated by paneling, said wall having an existing electrical toggle switch 33 installed in the usual electrical box 34. In accordance with the teachings of my invention, it is necessary to remove the usual cover plate screws (not illustrated) before installation of the paneling. Since the cover plate, indicated at 35 in FIG. 2, is to be retained in place, a suitable pressure-sensitive adhesive tape will preferably be used to attach the original cover plate against the wall until installation is completed. As illustrated in FIGS. 1 and 2, the paneling 36 will be nailed or otherwise secured to furring strips which, in turn, will be nailed through the existing wall surface into the wall studs (not illustrated). To install the electrical toggle switch extender 10, it is only necessary to provide an opening 37 in the paneling in alignment with the preexisting electrical toggle switch 33, the opening to be of sufficient size as permits passage of the underside of the actuating slide member 12 in either of its end positions with respect to the rectangular opening 20 in the associated cover plate 11. Upon completion of the paneling it is only necessary to apply cover plate screws 38, 39 through the usual cover plate screw openings 40, 41 in the outer cover plate 11 for passage through the respective openings in the original switch cover plate 35 and interthreading reception in the screw openings 42 and 43 in carriage plate 44 of the toggle switch 33 to be extended. Such use of the attachment screws 38, 39 will have a tendency to retain the existing cover plate 35 in its originally installed position. When installed as described above, the toggle switch lever 45 will be received within the recess 26 of the body member 25 of the carrier member 14, said body member recess being of such size that when the toggle switch lever is in its upward or "on" position, the actuating slide member 12 will be at or close to its uppermost position in the outer switch plate rectangular opening 20. When so positioned, as illustrated in FIG. 2, pressing downwardly upon the actuating slide member 12 serves to pivot the switch actuating lever 45 downwardly to snap in the downward or "off" position, whereat the actuating slide member 12 will be constrained at or near its lowermost position in the slide slot 20 by the toggle switch lever 45.

To accommodate for closer spacing between the outer surface of the renovated and original walls, an outer portion of the carrier member 14 can readily be broken away at the portion of decreased thickness 28. In instances where even closer spacing is required, a greater portion of the carrier member 14 can easily be cut away with a hacksaw, as may be appropriate.

While I have illustrated and described herein only one form in which my invention can conveniently be embodied in practice, it is to be understood that this embodiment is given by way of example and not in a limiting sense. My invention, in brief, comprises all the embodiments and modifications coming within the scope and spirit of the following claims.

What I claim as new and desire to secure by Letters Patent is:

1. In an electrical toggle switch lever extender for use in association with a toggle switch cover plate of the type having an elongated opening for the passage of a toggle switch lever, the improvement comprising, an actuating member receivable in said elongated opening in the cover plate for reciprocative motion with respect thereto in the direction of the major axis of said elongated opening, said actuating member comprising a knob portion at the outside of the cover plate and a recessed carrier portion at the inside of the the cover plate for the reception of an electrical toggle switch lever to be extended, said actuating member knob portion comprising a knob member integrally formed with slide abutment means receivable in the cover plate opening for constraining said knob member to rectilinear sliding movement therein, said recessed carrier portion comprising a separate carrier member, and means for removably attaching said carrier member with respect to said knob member at zones thereof within said cover plate opening, said carrier member comprising a hollow rectangular body portion having a terminal end portion defining said recess opening, said carrier member body portion being integrally formed, at the inner end thereof, with a pair of opposed, angularly-outwardly-extending wing portions, said wing portions projecting beyond the outer surface of the inside of said body portion and terminating in a plane parallel with the plane of said body portion outer surface.

2. The invention as defined in claim 1 wherein said knob member, at the inside thereof, is integrally formed with a flat marginal base portion, said base portion being provided near each end thereof with laterally opposed projections adapted to slidingly engage outer surface portions of said cover plate, the outer ends of said wing portions being in sliding abutment with inner surface portions of said cover plate.

3. The invention as defined in claim 2 wherein said attaching means comprises a central opening in said rectangular carrier member body portion, an attachment screw receivable in said central opening, and an opening in the underside of said knob member for the reception of said attachment screw.

4. The invention as defined in claim 2 wherein said attaching means comprises a central opening in said rectangular carrier member body portion, an attachment screw receivable in said central opening, a central post between said slide abutment members and integrally formed with said knob member, and an axial recess in said central post for the interthreading reception of said attachment screw.

5. The invention as defined in claim 2 wherein said hollow rectangular body portion terminates in a marginal end portion of reduced wall thickness to facilitate the breaking away thereof.

* * * * *